US010204749B2

(12) United States Patent
Todini et al.

(10) Patent No.: US 10,204,749 B2
(45) Date of Patent: Feb. 12, 2019

(54) APPARATUS FOR REMOTE MANIPULATION OF ELECTRIC EQUIPMENT

(71) Applicant: Telefonaktiebolaget LM Ericsson (publ), Stockholm (SE)

(72) Inventors: Mikael Todini, Sollentuna (SE); Thomas Nordlander, Täby (SE); Ulf Palm, Täby (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 24 days.

(21) Appl. No.: 15/129,862

(22) PCT Filed: Mar. 28, 2014

(86) PCT No.: PCT/SE2014/050378
§ 371 (c)(1),
(2) Date: Sep. 28, 2016

(87) PCT Pub. No.: WO2015/147716
PCT Pub. Date: Oct. 1, 2015

(65) Prior Publication Data

US 2017/0162343 A1 Jun. 8, 2017

(51) Int. Cl.
*H01H 3/20* (2006.01)
*H01H 17/00* (2006.01)
(Continued)

(52) U.S. Cl.
CPC ..... *H01H 3/28* (2013.01); *H01H 3/12* (2013.01); *H01H 3/46* (2013.01); *H01H 13/20* (2013.01);
(Continued)

(58) Field of Classification Search
CPC .. H01H 3/12; H01H 3/28; H01H 3/00; H01H 3/46; H01H 3/122; H01H 3/20; H01H 75/00; Y10T 307/937
(Continued)

(56) References Cited

U.S. PATENT DOCUMENTS 3,753,173 A * 8/1973 Goldberg ..... H01H 3/28 335/1
5,336,860 A * 8/1994 Slocum ..... H01H 13/20 200/332.1
(Continued)

FOREIGN PATENT DOCUMENTS

DE 9006937 U1 10/1990
EP 0087982 A2 9/1983
(Continued)

OTHER PUBLICATIONS

Unknown, Author, "Homemade Robot Keyboard Typing", XP00271 0770, YouTube, http://www.youtube.com/watch?v=3dKSPy4HbEk, May 12, 2009, 1-2.

*Primary Examiner* — Rexford Barnie
*Assistant Examiner* — Rasem Mourad
(74) *Attorney, Agent, or Firm* — Patent Portfolio Builders, PLLC

(57) ABSTRACT

An apparatus (200) for remote manipulation of an electric equipment. The apparatus (200) comprises a supporting structure (204) adapted to be attached to the electric equipment adjacent to a button (202*a*) of the electric equipment, and an elongated lever (206) attached to an axis (204*a*) of the supporting structure between a first end and a second end of the elongated lever such that the elongated lever is rotatable around the axis (204*a*). The apparatus (200) also comprises an actuation member (208, 210) adapted to actuate the first end of the elongated lever in response to an actuation signal (S) such that the elongated lever rotates
(Continued)

around the axis (204*a*) so to move a finger portion (206*c*) at the second end of the lever against the button with a predefined maximum length. Thereby, a precise and well-defined movement of the finger portion (206*c*) can fairly easy be created with a predefined maximum length which is sufficient to press the button (202*a*) to activate some function as desired, but without risking damage of the button (202*a*).

8 Claims, 3 Drawing Sheets

(51) Int. Cl.

| | |
|---|---|
| ***H01H 3/28*** | (2006.01) |
| ***H01H 13/20*** | (2006.01) |
| ***H01H 3/12*** | (2006.01) |
| ***H01H 3/46*** | (2006.01) |
| *H01H 3/32* | (2006.01) |

(52) U.S. Cl.
CPC .... *H01H 2003/323* (2013.01); *Y10T 307/937* (2015.04)

(58) Field of Classification Search
USPC ..... 335/6; 200/331–332, 329, 335, 338, 341
See application file for complete search history.

(56) References Cited

U.S. PATENT DOCUMENTS

| | | | | |
|---|---|---|---|---|
| 6,538,539 | B1 * | 3/2003 | Lu | H01H 3/46 200/331 |
| 2005/0194243 | A1 * | 9/2005 | Prineppi | H01H 3/26 200/556 |
| 2008/0289939 | A1 * | 11/2008 | Davidson, Jr. | H01H 13/08 200/331 |
| 2012/0024677 | A1 * | 2/2012 | Safreed, III | H01H 9/20 200/50.24 |
| 2014/0062623 | A1 * | 3/2014 | Fasano | H01H 71/2463 335/16 |
| 2014/0167889 | A1 * | 6/2014 | Einschenk | H01H 3/28 335/170 |

FOREIGN PATENT DOCUMENTS

| | | | |
|---|---|---|---|
| EP | 1724804 | A2 | 11/2006 |
| EP | 1950784 | A1 | 7/2008 |

* cited by examiner

APPARATUS FOR REMOTE MANIPULATION OF ELECTRIC EQUIPMENT

TECHNICAL FIELD

The present disclosure relates generally to an apparatus for remote manipulation of an electric equipment to achieve remotely controlled pressing of a button or the like on the electric equipment.

BACKGROUND

Electric or electronic equipment installed at a remote location are often manipulated by pressing a button or key or the like on the equipment which is typically designed such that the pressing of the button should be done by a person applying a suitable force on the button until it is activated, e.g. to turn on or off some function. In some cases it is desirable to accomplish the pressing of the button without requiring that a person must be present at the equipment to press the button. The equipment may be located far away or may be difficult or virtually impossible to access for whatever reason, and there may further be a need to press buttons of equipment at several locations distributed over a large area where the equipment may belong to some infrastructure such as networks for communication, power distribution, or lightning. It may therefore be quite costly and time consuming to have one or more persons going to all these locations, e.g. just to press a button on the equipment.

Communication networks of today, being used for serving various communication devices, typically comprise numerous network nodes which are distributed across an extensive geographic area. For example, a network for radio communication typically comprises a multitude of base stations or radio nodes capable of radio communication with wireless devices. The base stations and possibly other nodes in the network are frequently maintained and manipulated to achieve adequate or optimal operation of the network, and it is often required that a person must go to a network node in order to perform some maintenance work on the network node such as repair, modification or reconfiguration of one or more components therein. If the network is comprised of a great number of such network nodes, much time and efforts must be spent if one or more persons must actually go to each one of the nodes to perform such maintenance work. An example of a radio node in a radio network is shown in FIG. 1 where a base station equipment 100 comprises a control panel with one or more buttons 102 which are designed to be manipulated by humans. The button(s) 102 may be provided with a protecting plastic cover, e.g. for outdoor installations, to prevent water and moisture to enter and impair the button and any electronics behind.

In some cases, the only action that needs to be done at a remote site is to press a button or key on the electric equipment, e.g. in order to turn off or on the equipment or some function thereof. Sometimes a great number of nodes in a radio network need to be turned off and on in order to reboot the nodes or the like. To avoid the need for a person to perform the pressing, it is of course possible to install some automatic apparatus that does the pressing by applying mechanical force on the button in response to a remotely triggered activation signal. This may be accomplished by installing an electromechanical actuator such as an electromagnet to act on the button.

However, it is difficult to configure such an electromagnet installation so that the force applied upon the button is sufficient but not too great. Buttons on electric equipment are often quite sensitive and fragile, and they can easily be damaged if the applied force is too harsh. If a protecting plastic cover is used, there is e.g. a risk that the cover is punctured by the actuator. An electromagnet of sufficient size to achieve the required force, e.g. 10 Newton or more, will perform a quite hard and rapid movement on the button which may result in too high kinetic energy on the button. Using such an electromechanical actuator thus requires a very precise installation to work well which may be costly and time-consuming to achieve. Moreover, electromagnets typically generate unwanted heat and magnetic field which also may be harmful for the equipment.

SUMMARY

It is an object of embodiments described herein to address at least some of the problems and issues outlined above. It is possible to achieve this object and others by using an apparatus and method as defined in the attached independent claims.

According to one aspect, an apparatus is provided for remote manipulation of an electric equipment. The apparatus comprises a supporting structure adapted to be attached to the electric equipment adjacent to a button of the electric equipment. The apparatus also comprises an elongated lever attached to an axis of the supporting structure between a first end and a second end of the elongated lever such that the elongated lever is rotatable around the axis. The apparatus further comprises an actuation member which is adapted to actuate the first end of the elongated lever in response to an actuation signal such that the elongated lever rotates around the axis so as to move a finger portion at the second end of the lever against the button with a predefined maximum length. Thereby, it is possible to create a precise and well-defined movement of the finger portion with a predefined maximum length which is sufficient to press the button without risking damage of the button or other parts of the electric equipment.

According to another aspect, a method of using the apparatus is also provided. This method comprises attaching the supporting structure to the electric equipment in a position adjacent to the button, and applying an actuation signal to activate the actuation member to apply force against the button.

The above apparatus and method may be configured and implemented according to different optional embodiments to accomplish further features and benefits, to be described below.

BRIEF DESCRIPTION OF DRAWINGS

The solution will now be described in more detail by means of exemplary embodiments and with reference to the accompanying drawings, in which.

DETAILED DESCRIPTION

Briefly described, a solution is provided to enable use of an actuation member that will not cause damage when manipulating an electric equipment such that a button of the electric equipment is pressed in response to a remotely triggered actuation signal. Embodiments of this solution allow for usage of an actuation member of limited size and which can be placed at a sufficient distance from the equipment so as to avoid unwanted heat and magnetic field from the actuation member to affect or harm the electric equipment and its operation. An example of how an apparatus 200 for remote manipulation of an electric equipment may be constructed will now be described with reference to FIGS. 2*a* and 2*b*.

Figure 1:
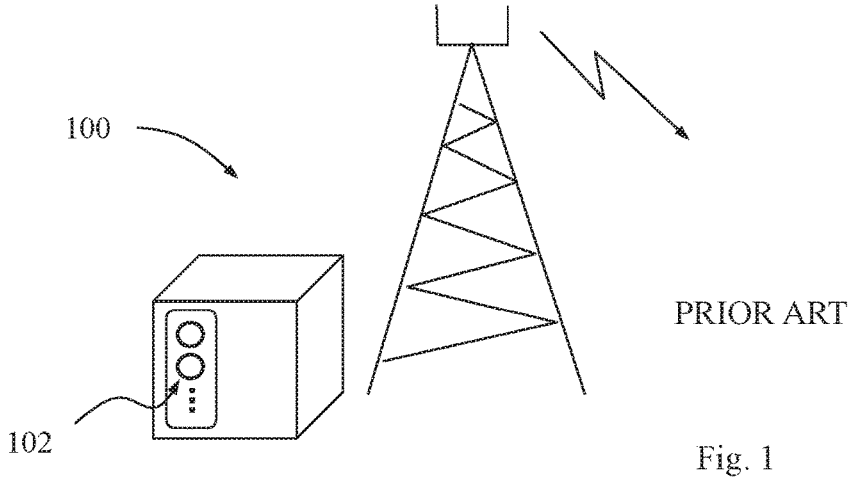
FIG. 1 is a simplified illustration of a node in a radio network, according to the prior art.
Figure 2A:
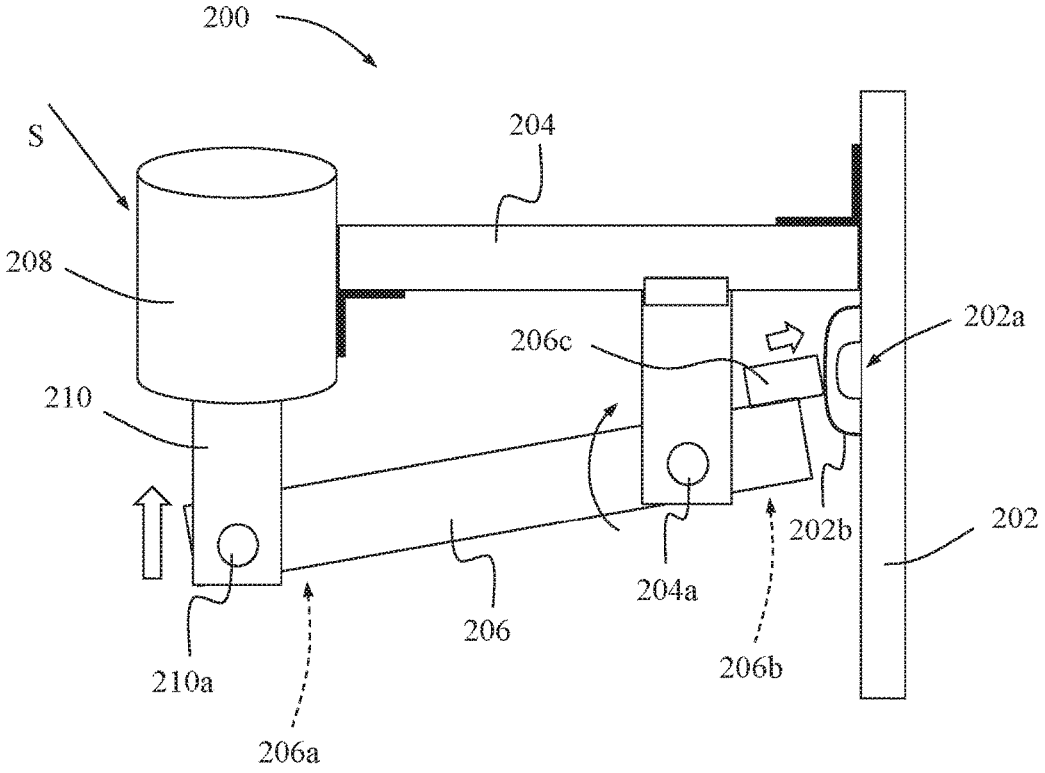
FIG. 2*a* is a side view of an apparatus for remote manipulation when not activated, according to a possible configuration.
Figure 2B:
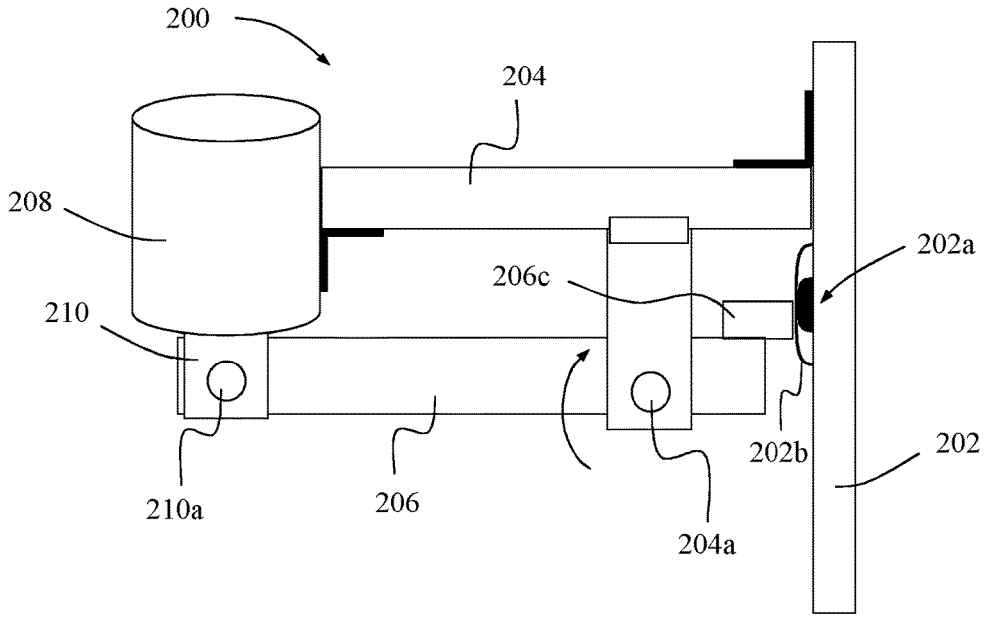
FIG. 2*b* is a side view of the apparatus of FIG. 2*a* when activated.

FIG. 2*a* illustrates the apparatus 200 before it is triggered to manipulate the electric equipment and FIG. 2*b* illustrates the apparatus 200 when it is triggered to manipulate the electric equipment. In the figures, the electric equipment 202 is schematically represented by a plate or wall-like element or the like upon which the apparatus 200 can be mounted as follows. The shown plate or wall-like element may be part of a base station or other radio network node, although usage of the solution is not limited to equipment for telecommunication and the electric equipment 202 may be of any type. It should thus be understood that the electric equipment in this context may comprise any components and elements which are not shown here for simplicity since they are not involved in the functionality of the described apparatus 200 as such. The electric equipment 202 comprises a schematically illustrated button 202*a* which may be covered by a plastic cover 202*b*, and the apparatus 200 is configured to press the button 202*a* for activating or de-activating some function of the electric equipment 202 in response to a remote actuation signal.

The apparatus 200 comprises a supporting structure 204 which is adapted to be attached to the electric equipment 202 adjacent to the button 202*a*. The supporting structure 204 has in this example been firmly mounted to the plate or wall-like element of the electric equipment 202 in a suitable manner, e.g. by means of some fastening elements such as bolts, screws or clamps, not shown. The supporting structure 204 may also be mounted to the electric equipment 202 by welding, gluing or soldering. The plate or wall-like element is shown here to have a mainly vertical orientation, although the apparatus 200 can be mounted in any orientation depending on where the button 202*a* is positioned on the electric equipment 202. Further, the apparatus 200 may comprise one or more adjustment screws for accurately adjusting its position relative the button 202*a*, to be described further below.

The apparatus 200 also comprises an elongated lever 206 attached to an axis 204*a* of the supporting structure 204 between a first end 206*a* and a second end 206*b* of the elongated lever such that the elongated lever 206 is rotatable around the axis 204*a*. A finger portion 206*c* is also arranged at the second end 206*b* of the lever 206 for producing the desired pressing force against button 202*a*. When the supporting structure 204 is firmly or fixedly attached to the electric equipment 202, the axis 204*a* is in a specific position relative the button 202*a*, which position may be accurately set or fixed to achieve a desired functionality. In this example, the supporting structure 204 has a mainly T-shaped configuration and the axis 204*a* is arranged on a base part of the T-shaped configuration. However, the supporting structure 204 may have any other configuration and position of the axis 204*a* as long as the functionality described herein is achieved.

The apparatus 200 further comprises an actuation member 208, 210 which is adapted to actuate, i.e. move, the first end 206*a* of the elongated lever 206 in response to an actuation signal "S" such that the elongated lever 206 rotates around the axis 204*a* so as to move the finger portion 206*c* at the second end 206*b* of the lever against the button 202*a* with a predefined maximum length, as indicated by a short white arrow. The actuation member comprises a fixed part 208 and a movable part 210 where the fixed part 208 is firmly attached to the supporting structure 204 and thus also in a fixed position relative the electric equipment 202 and its button 202*a*. The movable part 210 is arranged to move in one direction relative the fixed part 208, as indicated by a longer white arrow, when the actuation signal S is received and then in an opposite direction in a return movement. In a possible embodiment, the actuation member may be an electromechanical actuator comprising an electromagnet, although other types of actuation member may also be used to achieve the functionality described herein.

In another possible embodiment, the actuation member comprises a rod 210, being the above-mentioned movable part 210, which is pivotally attached 210*a* to the first end 206*a* of the elongated lever 206. The rod 210 is arranged to move in one direction relative the supporting structure 204, indicated by the long white arrow, when the actuation member is activated, to reach a position as shown in FIG. 2*b*. The rod 210 is also arranged to move in another opposite direction relative the supporting structure when the actuation member is deactivated to return to the position shown in FIG. 2*a*.

In another possible embodiment as shown in FIGS. 2*a* and 2*b*, the rod 210 is arranged to move upwards when the actuation member 208, 210 is activated to apply force against the button 202*a*, that is by means of rotating the lever 206 and thereby moving the finger portion 206*c* in a direction towards and against the button 202*a*, thus reaching the position shown in FIG. 2*b*. In this embodiment, the rod 210 is further arranged to fall downwards when the actuation member is deactivated so as to release the force against the button 202*a* when the finger portion 206*c* moves back again in a direction away from the button 202*a*, thus returning to the position shown in FIG. 2*a*. The rod 210 may fall downwards by its own weight and thus withdraw the finger portion 206*c* from the button 202*a*.

The apparatus 200 may be configured such that the finger portion 206*c* is oriented in a direction offset from the axis 204*a*, so that the finger portion 206*c* executes a limited rotating movement around the axis 204*a* when the actuation member 208, 210 is activated by the actuation signal S such that the lever 206 is rotated.

Another example of how an apparatus 300 for remote manipulation of an electric equipment may be constructed will now be described with reference to FIGS. 3*a* and 3*b*. As in the previous example, the electric equipment 302 comprises a button 302*a* which may be covered by a plastic cover 302*b*, wherein the apparatus 300 is configured to press the button 302*a* for activating or de-activating some function of the electric equipment 302 in response to a remote actuation signal.

The apparatus 300 comprises a supporting structure 304 which is adapted to be attached to the electric equipment 302 adjacent to the button 302*a*. The apparatus 300 also comprises an elongated lever 306 attached to an axis 304*a* of the supporting structure 304 between a first end 306*a* and a second end 306*b* of the elongated lever such that the elongated lever 306 is rotatable around the axis 304*a*. A finger portion 306*c* is also arranged at the second end 306*b* of the lever 306 for producing the desired pressing force against button 302*a*.

The apparatus 300 further comprises an actuation member 308, 310 which is adapted to actuate the first end 306*a* of the elongated lever 306 in response to an actuation signal S such that the elongated lever 306 rotates around the axis 304*a* so as to move the finger portion 306*c* against the button 302*a* with a predefined maximum length, as indicated by a short white arrow.

The actuation member comprises a rod 310 which is pivotally attached 310*a* to the first end 306*a* of the elongated lever 306. The rod 310 is arranged to move in one direction relative the supporting structure 304, indicated by the long white arrow, when the actuation member is activated, to reach a position as shown in FIG. 3*b*. The rod 310 is also arranged to move in another opposite direction relative the supporting structure when the actuation member is deactivated to return to the position shown in FIG. 3*a*.

So far, the description of apparatus 300 corresponds to the foregoing description of apparatus 200. While the movable part or rod 210 of FIG. 2 is arranged to move in a direction relative the fixed part 208, i.e. upwards in the figure, when the actuation signal S is received, the movable part or rod 310 of FIG. 3 is arranged to move in the opposite direction relative the fixed part 308, i.e. downwards in the figure, when the actuation signal S is received.

Figure 3A:
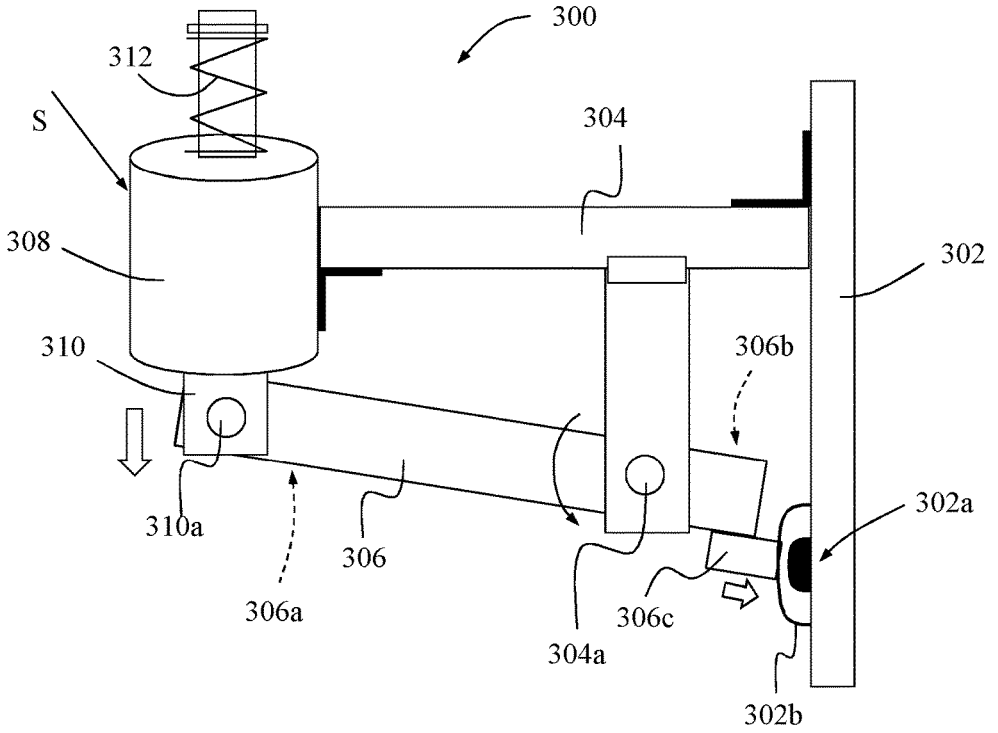
FIG. 3*a* is a side view of an apparatus for remote manipulation when not activated, according to another possible configuration.
Figure 3B:
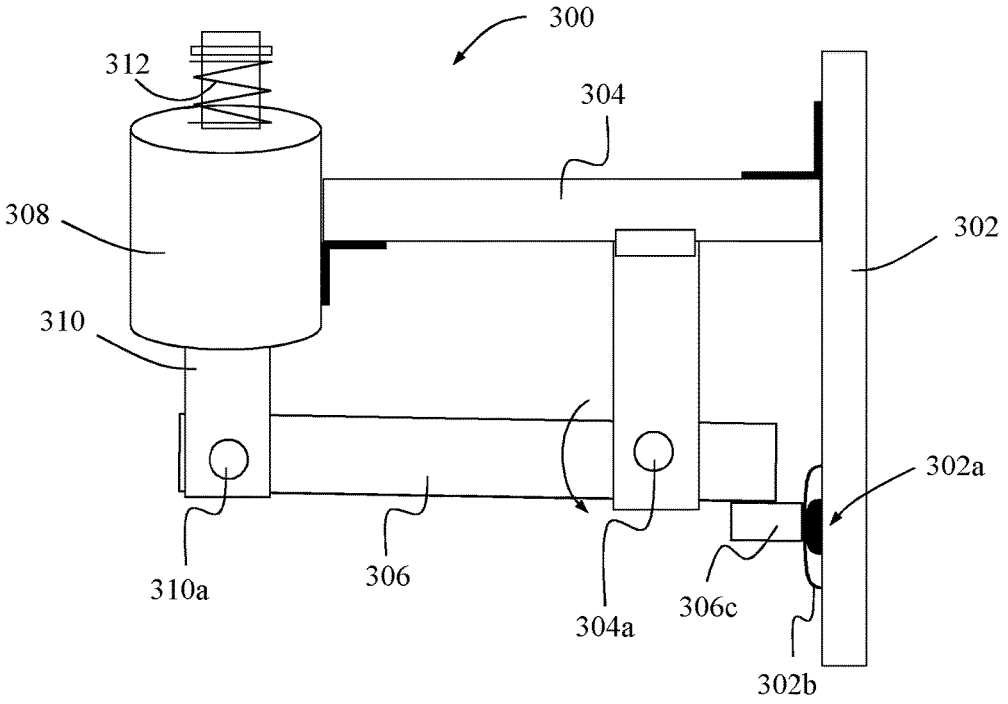
FIG. 3*b* is a side view of the apparatus of FIG. 3*a* when activated.

In another possible embodiment, in accordance with FIGS. 3*a* and 3*b*, the rod 310 is thus arranged to move downwards when the actuation member 308, 310 is activated to rotate the lever 306 and apply force against the button 302*a*, thereby moving the finger portion 306*c* in a direction towards and against the button 302*a*, thus reaching the position shown in FIG. 3*b*. In this embodiment, the rod 310 is further arranged to move upwards when the actuation member is deactivated so as to release the force against the button 302*a*. In this case, the actuation member 308, 310 may, according to another possible embodiment, comprise a mechanical spring 312 arranged to lift the rod 310 upwards when the actuation member is deactivated, that is to reach the position shown in FIG. 3*a*. The spring 312 is thus compressed when the actuation member 308, 310 is activated to move the rod 310 downwards to reach the position shown in FIG. 3*b*.

Also in the example of FIG. 3, the apparatus 300 may be configured such that the finger portion 306*c* is oriented in a direction offset from the axis 304*a*, so that the finger portion 306*c* executes a limited rotating movement around the axis 204*a* when the lever 306 is rotated.

In another possible embodiment, the actuation member may be adapted to be deactivated immediately after being activated. Thereby, the actuation member will cause the finger portion 206*c* or 306*c* to move towards and press against the button upon receiving the actuation signal S, and then return automatically to the non-pressed position without requiring any specific de-actuation signal. It may be observed that in the example of FIGS. 2*a*, 2*b*, the actuation member 208, 210 is activated to rotate the lever 206 clockwise, while in the example of FIGS. 3*a*, 3*b*, the actuation member 308, 310 is activated to rotate the lever 306 anticlockwise. However, other configurations of the apparatus 200 and 300, respectively, are also possible, for example the apparatus 200 and 300 may be configured in a mirrored fashion relative FIGS. 2*a*, 2*b* and 3*a*, 3*b*, respectively.

Figure 4:
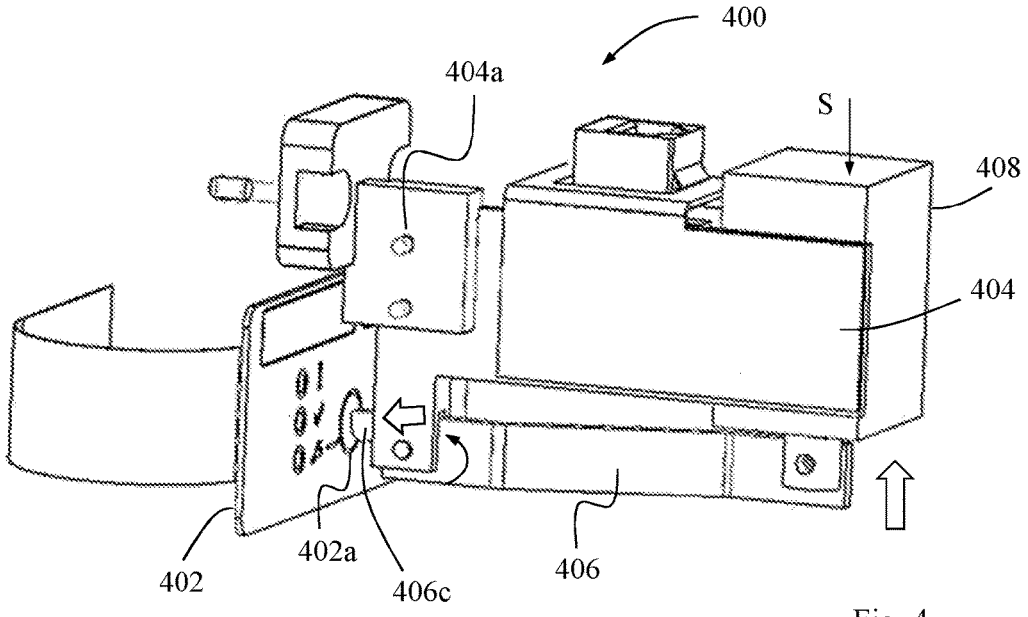
FIG. 4 is a perspective view of an apparatus for remote manipulation showing an example of how the apparatus may be implemented in practice.

FIG. 4 illustrates an example of how the above-described solution may be implemented in practice, showing an apparatus 400 for remote manipulation of an electric equipment 402 comprising a button 402*a*. The apparatus 400 comprises a supporting structure 404, an elongated lever 406 with a finger portion 406*c*, and an actuation member 408. The apparatus 400 and its parts 404, 406 and 408 may be configured according to any of the embodiments described above in connection with FIGS. 2*a*, 2*b* and 3*a*, 3*b*. In another possible embodiment, the apparatus 400 may further comprise one or more adjustment screws 404*a* for adjusting a position of the finger portion 406*c* relative the button 402*a*. Thereby, the finger portion 406*c* may be accurately positioned relative the button 402*a*.

A method of using the apparatus 200, 300, 400 is also defined. The method comprises attaching the supporting structure 204, 304, 404 to the electric equipment in a position adjacent to the button 202*a*, 302*a*, 402*a*, and applying an actuation signal S to activate the actuation member 208, 210, 308, 310, 408 to apply force against the button.

Some non-limiting examples of how the remotely triggered actuation signal mentioned throughout this description may be implemented in practice, will now be described. The above-described actuation signal may be conveyed from a central control unit over an Internet Protocol, IP, network. The IP control unit may be used for creating a suitable IP control command which is transmitted over the IP network to reach the apparatus and trigger the actuation member therein to operate in the manner described. The IP control unit may be connected via the IP network to such apparatus at several different locations, e.g. in a distributed infrastructure or the like, to remotely trigger the respective apparatus to press a button.

The IP control unit may further be operated manually or automatically to activate the apparatus, e.g. according to a pre-defined activation scheme where the apparatus at different locations is activated at pre-set occasions, either simultaneously or successively. Activation of the apparatus may be programmed to occur at certain intervals or at certain times of day, week or month, and so forth. The actuation signal may be a voltage that activates an electromagnet in the apparatus, or a logic signal such as an IP command that triggers the apparatus to operate as desired. However, the solution is not limited to these examples of generating the actuation signal which can be generated in any suitable manner, depending on the implementation.

Some potential advantages of the solution and its possible embodiments described herein include that a precise and well-defined movement of the finger portion can fairly easy be created with a predefined maximum length which is sufficient to press the button to activate some function as desired, but without risking damage of the button, e.g. punctuation of a plastic cover or demolition of the button's mechanism or the like. By transforming the relatively great and largely uncontrolled movement of the actuation member into a relatively small and precisely controlled movement of a predefined maximum length of the finger portion by means of the above-described lever rotation, a non-damaging pressing of the button can be achieved. Further, the solution also enables the actuation member to be positioned at a safe distance from the button such that damage of any underlying fragile circuits or the like by any generated unwanted heat and/or magnetic field is not likely to occur when the apparatus is used.

Further potential advantages include that an electromechanical actuator or similar can be employed without requiring costly and time-consuming installation to work well, in order to avoid that a person must go to the equipment to press the button. Moreover, since the apparatus will not damage the equipment nor its button when in use, the need to send out maintenance personnel for repair can be reduced or eliminated.

While the solution has been described with reference to specific exemplifying embodiments, the description is generally only intended to illustrate the inventive concept and should not be taken as limiting the scope of the solution. For example, the terms "electric equipment", "supporting structure", "elongated lever", "actuation member" and "finger portion" have been used throughout this disclosure, although any other corresponding components, members and/or parts could also be used having the features and characteristics described here. The solution is defined by the appended claims.

The invention claimed is:

1. An apparatus for remote manipulation of an electric equipment, the apparatus comprising:

a supporting structure adapted to be attached to the electric equipment adjacent to a push button of the electric equipment, the push button being operable by selectively applying and releasing a pushing force normal to a main surface of the push button, an elongated lever attached to an axis of the supporting structure between a first end and a second end of the elongated lever, such that the elongated lever is rotatable around the axis of the supporting structure, and an actuation member adapted to actuate the first end of the elongated lever in response to an actuation signal such that the elongated lever rotates around the axis of the supporting structure so as to move a finger portion at the second end of the elongated lever against the main surface of the push button and push the push button with the finger portion to a predefined maximum distance, wherein the actuation member comprises a rod pivotally attached to the first end of the elongated lever.

2. The apparatus of claim 1, wherein the actuation member is an electromechanical actuator comprising an electromagnet.

3. The apparatus of claim 1, wherein the rod pivotally attached to the first end of the elongated lever is arranged to move in one direction relative to the supporting structure when the actuation member is activated and to move in another opposite direction relative to the supporting structure when the actuation member is deactivated.

4. The apparatus of claim 3, wherein the rod is arranged to move upwards when the actuation member is activated to apply force against the push button, and to fall downwards when the actuation member is deactivated so as to release the force against the push button.

5. The apparatus of claim 3, wherein the rod is arranged to move downwards when the actuation member is activated to apply force against the push button, and to move upwards when the actuation member is deactivated so as to release the force against the push button.

6. The apparatus of claim 5, wherein the actuation member comprises a mechanical spring arranged to lift the rod upwards when the actuation member is deactivated.

7. The apparatus of claim 1, wherein the actuation member is adapted to be deactivated immediately after being activated.

8. The apparatus of claim 1, further comprising one or more adjustment screws for adjusting a position of the finger portion relative to the push button.

* * * * *